US005437110A

United States Patent [19]

Goldston et al.

[11] Patent Number: 5,437,110

[45] Date of Patent: Aug. 1, 1995

[54] ADJUSTABLE SHOE HEEL SPRING AND STABILIZER

[75] Inventors: Mark R. Goldston, Santa Monica; Jon Bemis, Rancho Palos Verdes; Alan Crawford, Burbank, all of Calif.

[73] Assignee: L.A. Gear, Inc., Santa Monica, Calif.

[21] Appl. No.: 13,700

[22] Filed: Feb. 4, 1993

[51] Int. Cl.[6] ..... A43B 21/30; A43B 13/28

[52] U.S. Cl. ..... 36/38; 36/27; 36/35 R

[58] Field of Search ..... 36/27, 35 R, 38, 78, 36/28, 37, 35 B, 34 R

[56] References Cited

U.S. PATENT DOCUMENTS

| | | | |
|---|---|---|---|
| 1,633,413 | 6/1927 | La Marca | 36/97 |
| 2,184,210 | 12/1939 | Burger | 36/37 |
| 2,821,793 | 11/1956 | Kornberg | 36/37 |
| 2,825,154 | 1/1957 | Windle | 36/38 |
| 2,836,907 | 8/1957 | Windle | 36/38 |
| 3,945,136 | 3/1976 | Koo | 36/38 |
| 4,342,158 | 8/1982 | McMahon et al. | 36/35 R |
| 4,391,048 | 7/1983 | Lutz | 36/30 RX |
| 4,680,876 | 7/1987 | Peng | 36/35 B |
| 4,756,095 | 7/1988 | Lakic | 36/2.6 |
| 4,815,221 | 3/1989 | Diaz | 36/28 X |
| 4,941,273 | 7/1990 | Gross | 36/114 |
| 5,138,776 | 8/1992 | Levin | 36/27 X |
| 5,187,883 | 2/1993 | Penney | 36/35 R |
| 5,224,278 | 7/1993 | Jeon | 36/27 X |

FOREIGN PATENT DOCUMENTS

| | | |
|---|---|---|
| 200368 | 7/1923 | United Kingdom . |
| 427126 | 4/1935 | United Kingdom . |

*Primary Examiner*—David T. Fidei
*Assistant Examiner*—BethAnne C. Cicconi
*Attorney, Agent, or Firm*—Don C. Lawrence

[57] ABSTRACT

An adjustable shoe heel spring and stabilizer device provides the wearer of a shoe the ability to adjust the energy absorption and return characteristics of the shoe to suit their particular needs. An operable adjustment device is located on an exterior surface of the shoe. The wearer operates the adjustment device to selectively position a fulcrum at a desired location relative to upper and lower members of a spring mechanism disposed within the mid-sole of the shoe. The position of the fulcrum defines the energy absorption and return characteristics for the shoe. An indicator is provided for displaying to the wearer the relative position of the fulcrum, and hence the energy absorption and return setting for the shoe.

15 Claims, 4 Drawing Sheets

Fig. 3.
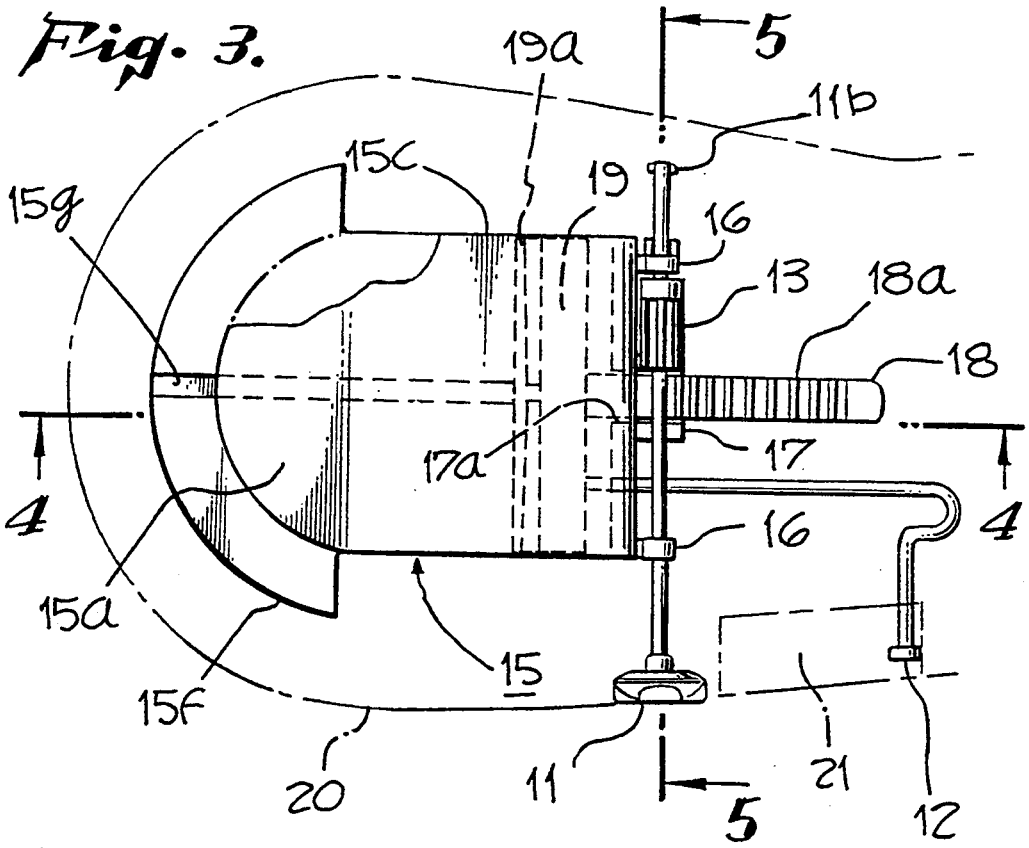
Fig. 4.
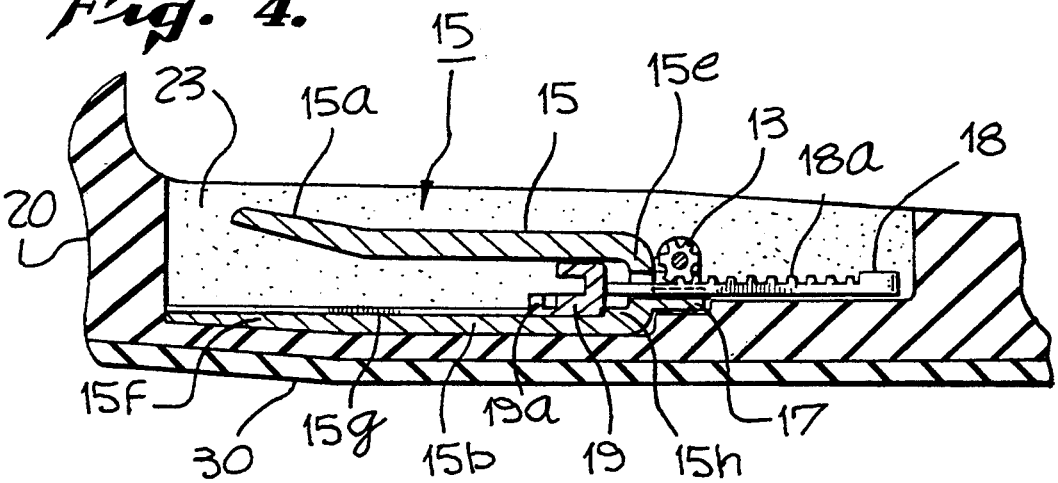
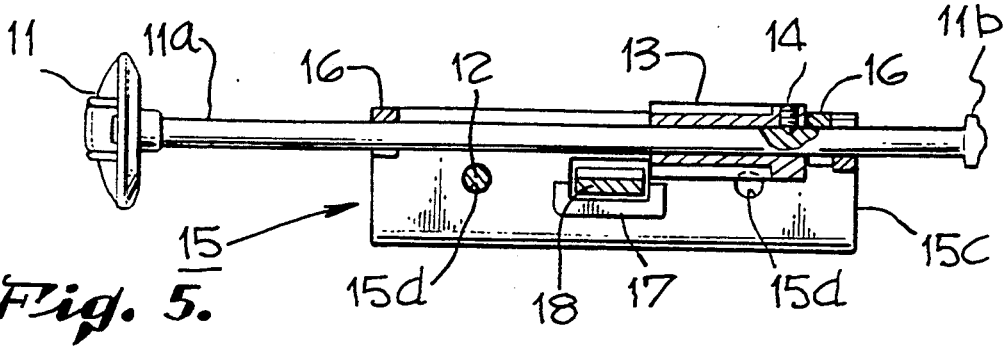
Fig. 5.

Fig. 6.
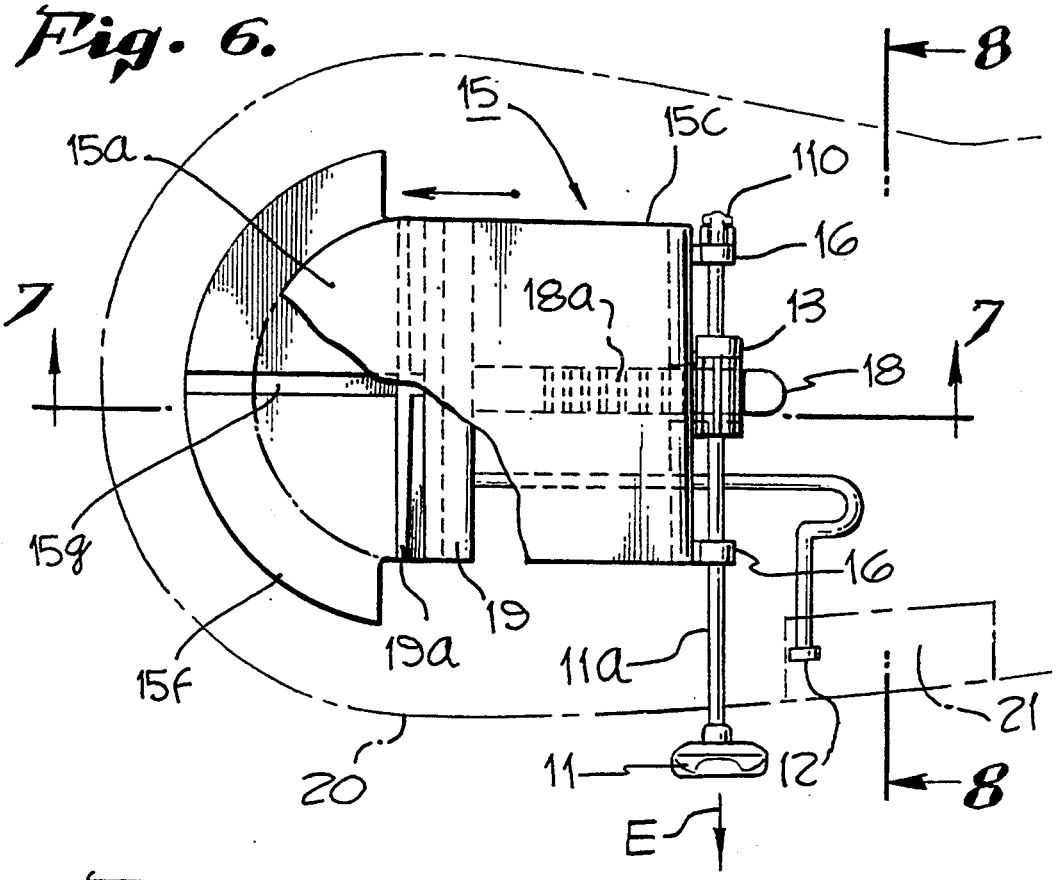
Fig. 7.
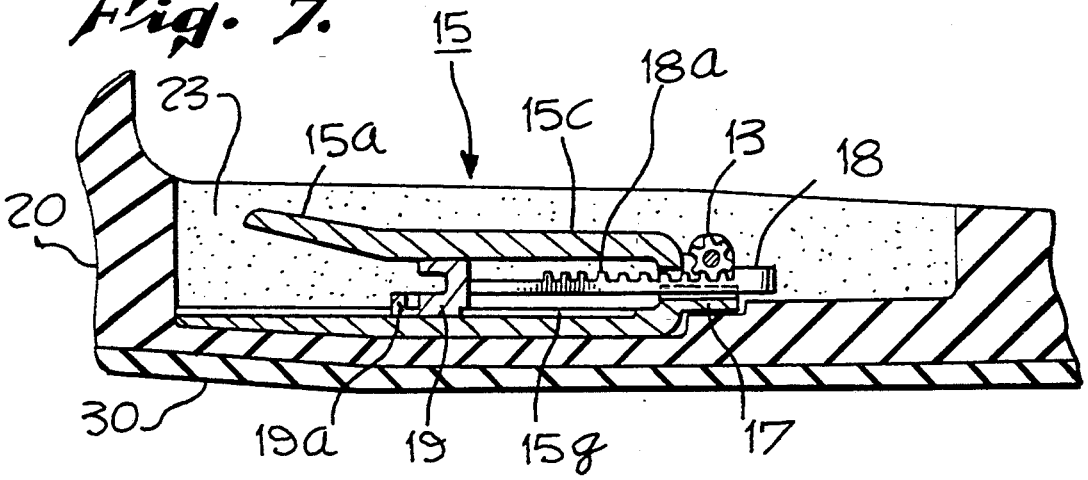
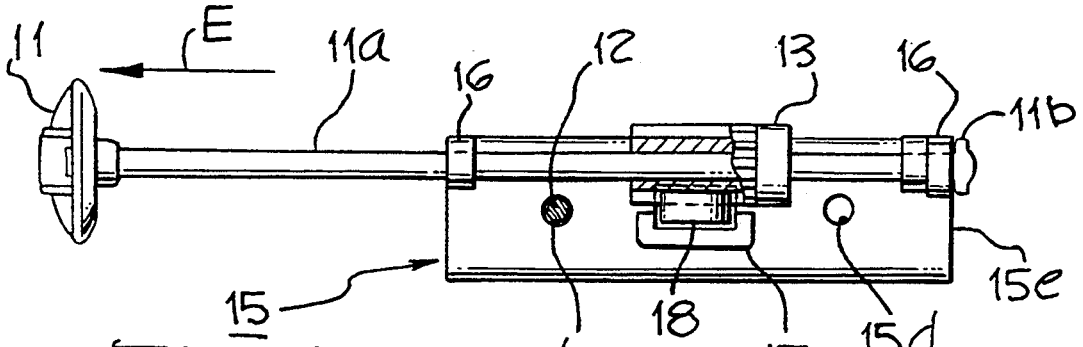
Fig. 8.

ADJUSTABLE SHOE HEEL SPRING AND STABILIZER

FIELD OF INVENTION

This invention pertains in general to footwear, and, in particular, to an adjustable shoe heel spring and foot stabilizing device for an athletic shoe.

DESCRIPTION OF THE RELATED ART

In general, the act of walking or running involves the use of the entire foot. For most, walking or running starts with a heel strike, followed by a rolling onto the mid-foot, and then finally by a propelling-off with the forefoot and toes. Before heel strike, the foot is in a supinated position, i.e., oriented with the ankle angled upwardly relative to the ground and twisted outwardly. At heel strike, the involved ankle, knee and hip all flex to cushion and absorb the shock of the impact. The foot rolls and turns inward in a process called pronation.

During this sequence, especially for an athlete, it is desirable to absorb as much of the foot-strike shock energy as possible, consistent with landing stability, in order to avoid chronic or traumatic injury to the athlete. Where possible, and again, consistent with good running stability, it is also desirable to store the shock energy absorbed and return it to the foot during the propelling-off portion of the stride, for energy-efficiency purposes. It is also desirable to limit any tendency of the foot to over-supinate or to over-pronate during contact of the foot with the ground, for both medical and running stability reasons.

Depending upon the nature of the activity in which the wearer is involved, the desired amount of energy absorption may change. For example, a long-distance runner may desire a high level of foot strike shock energy absorption, whereas, an individual who walks for exercise may not require, or desire, as much energy absorption. Rather, the walker may be more concerned with the energy return efficiency received from a shoe. In a similar fashion, depending upon a person's physical condition, they may desire more or less energy absorption and/or energy return efficiency.

For example, an individual who has chronic ankle, knee or hip ailments may desire a high level of energy absorption. In contrast, an athlete who is recovering from an injury may initially, in the beginning stages of a rehabilitation regimen, require a high level of energy absorption. In the later stages of the rehabilitation therapy, such an athlete may want to limit the energy absorption and/or increase the energy return efficiency to produce a higher stress on the injured area consistent with the rehabilitation regimen.

Thus, depending on the nature of the activity, or the particular needs of the individual wearer, it would be desirable to have a shoe which is capable of providing an adjustable amount of foot-strike shock energy absorption, resulting in a corresponding amount of stored shock energy. It would also be desirable to return the stored shock energy to the foot of the wearer during the propelling-off portion of the stride. Further, it would be desirable to provide a shoe with the adjustable energy absorption and return characteristics as discussed above which is also capable of stabilizing the foot of the wearer to limit the tendency of the foot to over-supinate or to over-pronate during contact of the foot with the ground.

It is known in the shoe art to incorporate spring devices in the soles of shoes, and particularly, the heels of shoes, to store shock energy imparted by foot strike during running and to return at least a portion of that energy to the wearer's foot during foot lift. It is likewise known to provide transverse and longitudinal stiffening elements within the sole of a shoe to overcome the effect of over-supination or over-pronation of the wearer's foot during running.

For example, in U.S. Pat. Nos. 4,486,964 and 4,506,460, M. F. Rudy describes various types of plastic and heat-treated steel "spring moderators" whose primary purpose is said to be to distribute foot strike forces more evenly and quickly to underlying, gas-filled sole member. A horseshoe-shaped heel component of these moderators is said to act like a Bellville spring in cooperation with the foot to store and return energy during running, and in one version, is also said to provide stabilization of the ankle.

In U.S. Pat. Nos. 2,357,281 and 2,394,281, V. P. Williams discloses a shock resisting built-up heel assembly for dress shoes which incorporates a steel spring. The outer portion of the heel is molded of rubber with an internal cavity and a protrusion extending from the bottom of the heel. Upon heel strike, the protruding portion of the heel contacts the ground first and then collapses into the cavity formed in the heel. The steel spring serves primarily to re-extend the protruding portion of the heel upon heel lift.

In U.S. Pat. No. 4,709,489, K. Welter describes a spring device for a shoe heel which comprises a steel plate supported at its lateral ends by a U-shaped, non-compressible support member. In addition to providing a heel-spring effect, the support member is also said to provide lateral stabilization of the heel.

In U.S. Pat. No. 4,881,329, K. Crowley discloses yet another form of energy storing heel spring that is said to be manufactured from high tensile materials such graphite and/or glass fibers and resin.

In U.S. Pat. No. 4,815,221, J. Diaz discloses an energy control system positioned in a cavity formed in the mid-sole of an athletic shoe. Diaz provides a spring plate having a plurality of spring projections depending from, and distributed over, the surface of the plate. The plurality of spring projections absorb energy during heel strike and return the energy to the foot of the wearer during the propelling-off portion of the stride. Because of the structure of the spring members, the energy which is returned to the wearer's foot has a forward component to assist in propelling the wearer in the forward direction.

Finally, in U.S. Pat. Nos. 4,854,057, and 4,878,300, to K. Misevitch, et al. and R. Bogaty, respectively, various configurations of stability plates are shown which are made of various compositions of fiberglass and polyester resin.

SUMMARY OF THE INVENTION

This application is directed to a novel device which is disposed in the mid-sole of a shoe, preferably an athletic shoe, including an adjustable heel spring, which is capable of being adjusted by the wearer depending upon the wearer's particular needs for shock energy absorption. The wearer operates an easily accessible adjustment mechanism to change the shock absorbing and energy return characteristics of the device. The adjustable heel spring absorbs, stores and returns to the wearer's foot shock energy experienced during walking or running.

A stabilizer plate is provided, which, during the same activity, aids in the prevention of the over-supination and over-pronation of the foot. The adjustable shoe heel spring and stabilizer device of the present invention is simple for the wearer to operate, is inexpensive to manufacture, and has the added advantage of being very light in weight, which makes it ideally suited for use in athletic shoes.

A better understanding of the device, along with its many attendant advantages, can be had from a consideration of the detailed description of its preferred embodiments which follows hereinafter, particularly when considered in light of the accompanying drawings, of which the following is a brief description.

BRIEF DESCRIPTION OF THE DRAWINGS

FIG. 3 is a partial top view of the mid-sole of a shoe of FIG. 1 showing the fulcrum in a first position;

FIG. 4 is a partial side view taken along the line 4—4 of FIG. 3 showing the device of the present invention disposed in a cavity formed in the mid-sole of a shoe of FIG. 1;

FIG. 5 is a partial rear view of the device according to the present invention taken along the line 5—5 of FIG. 3;

FIG. 6 is a partial top view of the mid-sole of the shoe of FIG. 1 which shows the fulcrum in a second position;

FIG. 7 is a partial side view showing the device of the present invention incorporated within the mid-sole of the shoe of FIG. 1 taken along the line 7—7 in FIG. 6;

FIG. 8 is a partial rear view of the device of the present invention taken along the line 8—8 in FIG. 6.

DETAILED DESCRIPTION OF THE PREFERRED EMBODIMENTS

Figure 1:
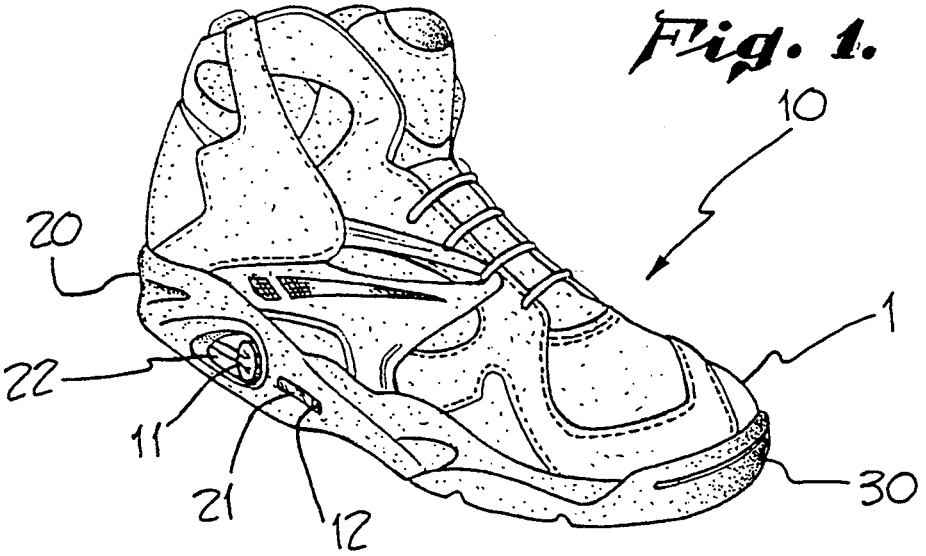
FIG. 1 is a perspective view of a right-foot athletic shoe within which the device of the present invention is incorporated.

In FIG. 1, the illustrated athletic shoe 10 includes an upper 1 which is attached to a mid-sole 20 and an out-sole 30. The mid-sole 20 has a window 21 formed therein through which can be seen a position indicator 12, which displays an indication of the relative position of the fulcrum discussed in more detail below. The window 21 may be covered with a clear plastic or other suitable material to prevent debris from entering the interior of the mid-sole 20. A recess 22 is formed in the exterior surface of the mid-sole 20 to accommodate a knob 11, which is utilized by the wearer shoe 10 to adjust the shock absorbing and return energy characteristics of the device of the present invention as discussed in detail below. The mid-sole 20 is generally formed from a polyurethane ("PU") material but may be formed of other resilient materials such as compression molded ethyl vinyl acetate ("EVA"). The out-sole 30 extends below the mid-sole 20 along the bottom portion of the shoe 10.

Figure 2:
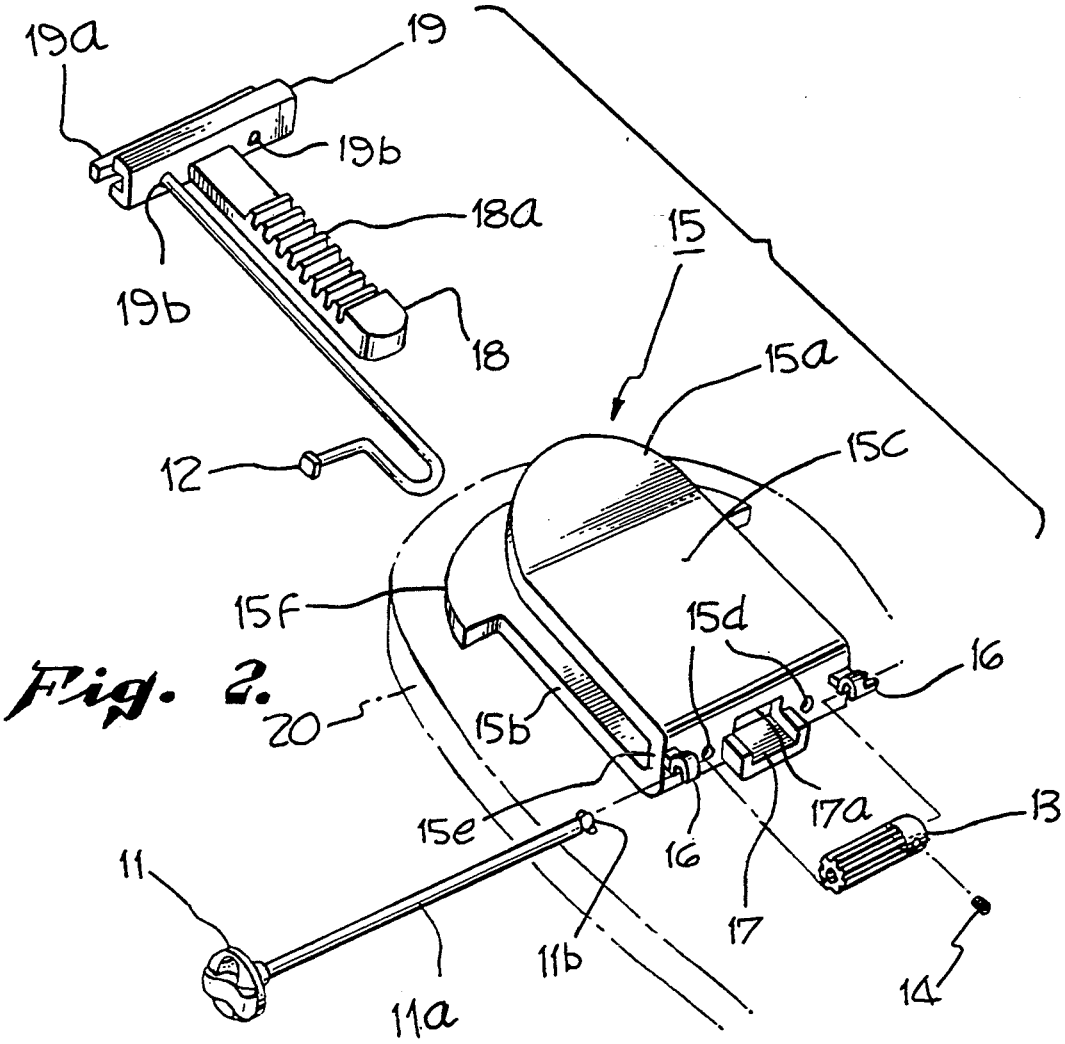
FIG. 2 is a partial view showing the constituent parts of the device of the present invention.

FIG. 2 shows the constituent parts of the present invention in disassembled form. As illustrated, the knob 11 connects with a shaft 11*a* which extends to the interior of the mid-sole 20. The knob 11 and the shaft 11*a* may be formed as one piece from a single material in a molding process, or the knob may be manufactured separately and secured to the end of the shaft 11*a*. The shaft 11*a* has a nub 11*b* formed on an end opposite the knob 11 to prevent the wearer of the shoe from removing the shaft 11*a* from the mid-sole 20 when utilizing the knob 11 to adjust the position of a fulcrum 19. In an alternative embodiment, the nub may be replaced with a C-clip formed of metal or other suitable material.

Disposed on the shaft 11*a* is a gear 13 which can be held in place with screw 14, or which can be adhered to the shaft 11*a*. The gear 13 slidably engages a rack 18 having a plurality of teeth 18*a* formed thereon which mesh with corresponding teeth on the gear 13. The rack 18 may be molded in an integral fashion with the fulcrum 19 in a single molding process, or, they may be molded separately and joined by way of an epoxy adhesive, cyanoacrylate, or other such adhesive. The fulcrum 19 can incorporate a forward or bumper portion 19*a* which is molded in a integral fashion with the fulcrum 19. The bumper portion 19*a* can serve as a means for limiting the rearward movement of the fulcrum 19. The fulcrum 19 and the bumper portion 19*a* are molded with an extension to slidably engage a longitudinal slot 15*g* (FIG. 3) formed in the upper surface of the bottom plate 15*b* of the spring mechanism 15. The slot 15*g* serves to guide the fulcrum 19 longitudinally and restrict any lateral movement of the fulcrum.

Alternatively, the bottom plate 15*b* of the spring mechanism 15 may have a ridge in place of the slot 15*g* formed thereon, with the fulcrum 19 and bumper portion 19*a* each having a slot formed in a lower surface thereof to slidably engage the ridge. The fulcrum 19 forms a moveable pivot point for the spring member so that the spring rate of the spring member can be adjusted. This adjustment can be analogized to adjusting the stiffness or spring rate of a diving board.

To adjust the relative position of the fulcrum 19, the wearer uses the knob 11 to slide the shaft 11*a* in a perpendicular direction relative to the rack 18. This causes the teeth in the gear 13 to engage the teeth 18*a* formed on the rack 18. Once the gear 13 has engaged the teeth 18*a*, the wearer may then, by turning the knob 11 in a clockwise or counter-clockwise fashion, cause the fulcrum 19 to move in and out in a guided fashion along the slot 15*g*.

Spring mechanism 15 is disposed in the mid-sole 20 and includes a cantilevered spring member having an angled portion 15*a* that inclines at an angle which is upward and rearward relative to the plane of a level portion 15*c*. The level portion 15*c* is positioned to be generally horizontal with respect to the out-sole 30, and extends from a connecting member 15*e* located at a forward end of the spring mechanism 15 towards the rear of the mid-sole 20. The angled portion 15*a* terminates in a rounded fashion towards the rear of the mid-sole 20. For convenience, hereinafter the spring member will be referred to as spring member 15*a,c*.

The spring mechanism 15 is generally heel-sized and is positioned within the mid-sole 20 so that the spring member 15*a,c* is generally disposed below the calcaneus, or heel bone, of the wearer's foot. For the purposes of this disclosure, heel-sized means that at least a portion of the spring mechanism 15 extends to a position equal to, or slightly outboard of, the sides of the wearer's heel. As a result, the spring mechanism, in addition to providing for foot-strike shock energy absorption and return, will act in a manner analogous to outriggers on a canoe to provide stability and prevent over-supination and over-pronation of the wearer's foot.

At heel strike, the spring member 15*a,c* is deflected downward to absorb and store the foot-strike shock energy. At the propelling-off portion of the stride, the surfaces 15*a* and 15*c* return to their positions prior to heel strike and, in the process, the spring member 15*a,c* returns the stored shock energy to the foot of the wearer.

The spring mechanism 15 includes a bottom plate 15*b* which extends from a connecting member 15*e* at the front portion of the spring member 15*a,c,* towards the rear with dimensions which initially are substantially equal to that of the level portion 15*c*. The spring member 15*a,c* is cantilevered above the bottom plate 15*b*. At a position on the bottom surface plate 15*b,* which is located approximately below the point where the angled portion 15*a* meets the level portion 15*c,* the bottom plate 15*b* includes an extended rear portion 15*f* which extends laterally outward a uniform distance towards the side edges of the mid-sole 20.

The extended rear portion 15*f* forms a semi-circle at a generally uniform distance from the outer edges of the mid-sole 20. The dimensions of the extended rear portion 15*f* are determined so that the outer edges are slightly outboard of the sides of the wearer's heel. In this fashion, the wearer will not tend to "roll-off" of the spring member 15. Thus, extended rear portion 15*f* of the bottom plate 15*b* of the spring mechanism 15 provides enhanced lateral stability which assists in preventing over-supination and over-pronation of the wearer's foot.

A connecting member 15*e* connects the spring member 15*a,c* with the bottom plate 15*b*. The connecting member 15*e* is provided with holes 15*d* to allow the indicator rod 12 to pass through the connecting member 15*e*. Two holes are provided so that only a single spring mechanism 15 needs to be made for either a right or a left shoe. The indicator rod 12 is attached to the fulcrum 19 and moves in unison therewith to provide an indication of the relative position of the fulcrum with respect to the spring member 15. Molded with the spring mechanism 15 are bosses or guides 16 which slidably engage the shaft 11*a* and serve to maintain the position of the shaft 11*a* within the mid-sole 20.

As can be seen in FIG. 2, the fulcrum 19 is slid into the opening formed between the spring member 15*a,c* and bottom plate 15*b* such that the rack 18 extends through the opening 17*a* formed in the connecting member 15*e*. A guide 17 is molded integrally with the connecting member 15*e* and serves as a guide for the rack 18.

The shaft 11*a* slidably and rotatably engages the bosses or guides 16 with the nub or C-ring 11*b,* thereby preventing the shaft 11*a* from being pulled such that it disengages the guides or bosses 16. Finally, FIG. 2 clearly shows the spring mechanism 15 being disposed at the rear portion of the mid-sole 20 towards the back of the shoe 10 so as to be disposed under the calcaneus or heel bone of the wearer's foot to provide the maximum shock-absorbing effect for the wearer during heel-strike FIG. 3 shows the fulcrum 19 positioned between the upper and lower surfaces of the spring mechanism 15 at the most forward position. The knob 11 is flush with the exterior side surface of the mid-sole 20; thus, the gear 13 is disengaged from the rack 18.

In an alternative embodiment, it is possible to utilize a spring (not shown) to bias the shaft 11*a* and the knob 11 to maintain the knob 11 in the position shown in FIG. 3. When a spring is used to bias the knob 11, the wearer simply pulls the knob 11 with a force sufficient to overcome the force of the biasing spring to adjust the position of the fulcrum 19. The gear 13 engages the rack 18 and the knob 11 is turned as discussed above to adjust the position of the fulcrum. When the adjustment of the fulcrum is complete, the wearer simply releases the knob 11 and the force of the biasing spring "snaps" the knob back to an out-of-the-way position flush with the exterior side wall of the mid-sole 20.

As can be seen in FIG. 3, the indicator rod 12 is positioned fully forward in the opening 21 to signify to the wearer that the fulcrum 19 is positioned fully forward with respect to the bottom plate 15*b* and spring member 15*a,c*. The position of the rod 12 relative to the opening 21 provides the wearer with an indication of the relative position of the fulcrum 19 with respect to the spring member 15*a,c,* and hence, the stiffness of the spring member 15*a,c*. Of course, opening 21 can also be provided with visible indicia to assist the wearer in gauging the position of the fulcrum 19. The end of the rod 12 may also be brightly colored to appear readily apparent to the wearer of the shoe.

As can be seen in FIG. 4, the spring mechanism 15 is molded as a single integral piece. The angled portion 15*a* can be formed in a tapered fashion. This tapering serves to assist in shock absorption, particularly when the fulcrum is positioned at the rearmost position, as illustrated in FIG. 7 and discussed below. Similarly, the extended rear portion 15*f* of the bottom plate 15*b* is tapered. The tapering of the extended rear portion matches a corresponding cut-out formed in the out-sole 30. This tapering of the bottom plate eases the initial impact during heel strike by assisting in providing a controlled foot plant. This provides an additional measure of stability for the wearer.

For illustration purposes only, the fulcrum 19 is shown in spaced relationship with the lower surface of the level portion 15*c* of spring member 15*a,c*. Preferably, the spacing between the fulcrum 19 and the spring member 15*a,c* and bottom plate 15*b* is such as to allow the fulcrum 19 to move relative to the spring member 15*a,c* and to avoid having frictional forces prevent the movement of the fulcrum 19. Friction or galling can also be avoided by making the fulcrum 19 from a different material than that of the spring mechanism 15. In particular, a fulcrum 19 made of Delrin, which is an acetal resin, will slide easily when the spring member is a glass or carbon filled thermoplastic.

FIG. 4 shows a cavity 23 which is molded in the mid-sole 20 to allow the device of the present invention to be positioned therein. The spring mechanism 15 may be secured in the cavity 23 with an adhesive, such as cyanoacrylate, which would be applied between the mid-sole 20 and the bottom plate 15*b* of the spring member.

As illustrated in FIG. 4, the fulcrum 19 is positioned almost to the connecting member 15*e*. The bottom plate 15*b* of the spring mechanism 15 may be molded to include a ridge 15*h* to serve as a stopper to define the forwardmost position of the fulcrum 19 relative to the spring mechanism 15. Alternatively, the fulcrum 19 could utilize the connecting member 15*e* to serve as a stopper to define the forwardmost position of the fulcrum 19.

To limit the rearward movement of the fulcrum 19, the front portion of the rack 18, which lacks teeth, serves to limit the rearward movement of the fulcrum 19. That is, as the gear 13 is turned via the knob 11 in the clockwise direction in the FIGURE, the fulcrum 19 will slide towards the rear of the shoe 10. When the gear 13 encounters the flat, raised-surface portion of the rack 18, the gear 13 will be unable to turn any further. At this point, the fulcrum 19 will be positioned at the maximum rearward position relative to the spring member 15. This position is illustrated in FIG. 5.

With the fulcrum positioned as shown in FIG. 4, the spring mechanism 15 will provide the wearer with the most shock absorbency and the most "bounce" i.e., energy return characteristics. That is, in the position illustrated in FIG. 4, the spring mechanism 15 will allow the maximum downward deflection of the upper surfaces 15*a* and 15*c* when the wearer experiences heel strike during walking or running. Consequently, this is also the position which will provide the most return energy to the foot of the wearer when the upper surfaces 15*a* and 15*c* "spring" upward after being deflected downward.

As also illustrated in FIG. 4, the spring mechanism 15 is positioned in a generally horizontal fashion relative to the out-sole 30. Further, as can be seen in FIG. 3, the bottom plate 15*b* is formed in a generally parallel relationship with the level upper surface portion 15*c* of the spring member 15. At a pre-determined position, which may correspond with the maximum reach of the fulcrum 19, the angled upper surface portion 15*a* is formed to incline in an upward and rearward fashion relative to the plane of the spring member 15. Although not illustrated in FIGURE 4, a molded covering is formed to be positioned over the adjustable heel spring and stabilizer device 15. The cover is molded so as not to interfere with the movement of the rack 18 and the gear 13.

FIG. 5 shows the shaft 11*a* with knob 11 engaging the molded bosses or guides 16 on the front wall surface of the spring member 15. Alternatively, a pin or other such device may be utilized to secure the gear 13 to the shaft 11*a*. In another possible embodiment, the knob 11, the shaft 11*a* and the gear 13 may be integrally molded as a single piece from an acetal plastic or other suitable material. Gear 13 is formed with lateral dimensions such that the gear 13 will be disengaged from the rack 18 when the knob is pushed into the recess 22 formed in an exterior surface of the mid-sole 20. This is the position illustrated in FIG. 5.

Finally, the guide 17 illustrated in FIG. 5 is formed in a U-shaped fashion and is sized so as to accommodate the rack 18. In addition to guiding the rack 18, the guide 17 serves to prevent the rack from bending downward when the gear 13 slidably engages the teeth 18*a*.

Referring to FIG. 6, the fulcrum 19 is illustrated in the rearward-most position relative to the spring member 15. The indicator rod 12 is also positioned closely adjacent to the rear wall surface of the opening 21. FIG. 6 also illustrates the gear 13 engaging the teeth 18*a* formed on the rack 18. This is accomplished by pulling the knob 11 outward from the mid-sole 20 in the direction indicated by arrow E. In the preferred embodiment, when the nub or C-ring 11*b* positioned on the shaft 11*a* encounters the molded boss or guide 16, the gear 13 will be appropriately positioned and engaged with the rack 18.

With the fulcrum 19 positioned as in FIG. 7, the heel of the shoe will feel "stiffer" to the wearer of the shoe. The spring mechanism 15 will have the less shock absorbency and consequently will provide less return energy to the foot of the wearer. With this placement of the fulcrum 19, the shock absorber for the wearer essentially comprises the tapered, angled portion 15*a*, rather than both the angled and level portions 15*a*, 15*c*, respectively.

At this point, the relationship between shock absorbency and energy return efficiency should be noted. That is, the relationship provides that the stiffer the spring mechanism, the greater the energy return efficiency. Accordingly, with a stiffer spring constant, a greater percentage of the absorbed energy will be returned to the foot of the wearer, within limits.

FIG. 8 shows the engagement of the gear 13 with the rack 18 when the wearer of the shoe pulls the knob 11 along the direction of arrow E indicated in the FIGURE.

Figure 9:
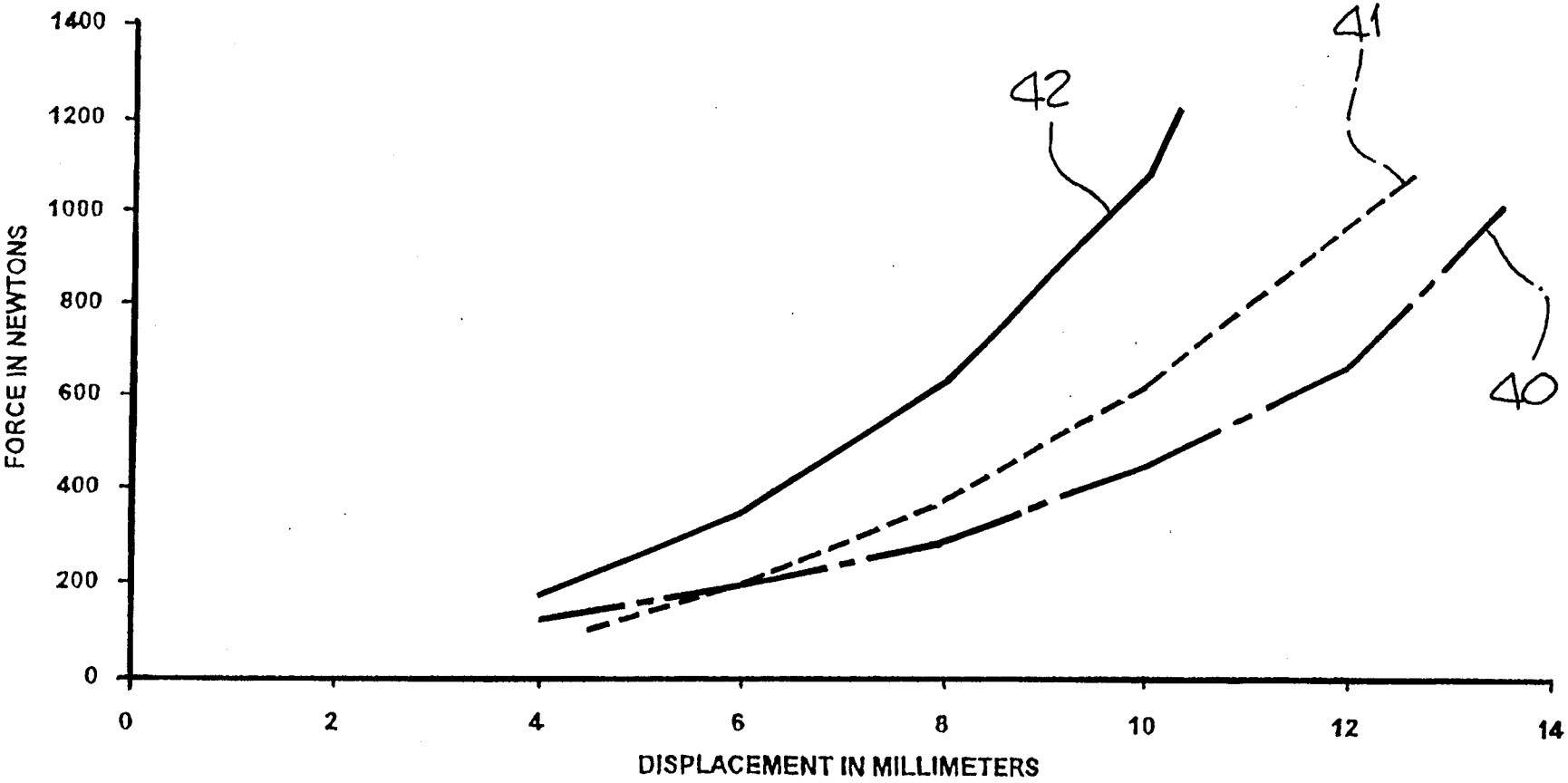
FIG. 9 is a graphical representation of the displacement of the spring member relative to an applied force for selected positions of the fulcrum.

In FIG. 9, curves 40, 41, and 42 represent average spring rate data obtained with the fulcrum positioned at the most forward position adjacent the connecting member 15*e* (the "zero" position), at a first position rearward of the zero position, and at a second position rearward of both the zero position and the first position, respectively.

The zero position, corresponding to curve 40, is the fulcrum position illustrated in FIGS. 3 and 4. When a force of 200 newtons is applied, the average displacement of the spring member 15*a,c* for the illustrated fulcrum positions is about 4 millimeters. However, as can be seen from curve 40, when a force of 1,000 newtons is applied and the fulcrum is in the zero position, the displacement is approximately 13.5 millimeters.

In contrast, as shown by curve 42, with the fulcrum 19 at a selected position rearward of the zero and first position, when a force of 1,000 newtons is applied, the relative average displacement of the spring member 15*a,c* is approximately 9.5 millimeters. This is approximately 4 millimeters less than that seen above with the fulcrum 19 in the zero position. This will feel noticeably "stiffer" or less "bouncy" to the wearer than if the fulcrum 19 were in the zero position where the wearer would feel approximately 4 additional millimeters of displacement.

While the data in FIG. 9 indicates that the positions of the fulcrum 19 relative to the spring mechanism 15 show similar characteristics when less than 200 newtons of force are applied, as the amount of force increases, the relative average displacement of the spring mechanism 15 is markedly different.

Finally, it should be noted that it may be possible to extend the fulcrum rearwardly to such an extent that the level portion 15*c* acts as a suspended beam, i.e., similar to a spring board, such that the spring mechanism actually starts to feel "softer" the further back the fulcrum 19 is moved. To avoid confusing the wearer with such a situation, the fulcrum 19 can be controlled to halt the rearward movement thereof at a position corresponding to the "stiffest" feel from the spring mechanism 15.

The skilled practitioner will recognize from the foregoing discussion that many modifications are possible to the features, materials and methods of manufacture of the adjustable shoe heel spring and stabilizer device disclosed above, depending upon the particular problem or application at hand.

For example, rather than relying upon the raised flat surface of the rack 18 to serve as the means for halting the rearward movement of the fulcrum 19, it would be possible to provide protuberances on the bottom plate 15*b* of the spring mechanism 15 to engage the bumper portion 19*a* of the fulcrum 19 and halt the rearward movement of the fulcrum at a predetermined point.

Further, one skilled in the art would readily recognize that it is not required for the rod 12 to extend from the fulcrum 19 through the connecting member 15*e* to appear forward of the knob 11 on the exterior surface of the mid-sole 20, but rather, rod 12 may be formed as an extension of the fulcrum 19 to extend directly to the exterior side surface of the mid-sole 20. Additional means for indicating the relative position of the fulcrum 19 relative to the spring mechanism 15 are possible, and it is intended that all such means be encompassed within this description.

Similarly, while the preferred embodiment of the present invention illustrates the spring member being positioned at a horizontal position relative to the out-sole 30, one skilled in the art may be able to mold the spring mechanism 15 such that the spring action is directed in a slightly forward fashion to provide a forward component to the return energy of the spring member 15. This might entail positioning the spring mechanism 15 at a position other than at a horizontal to the out-sole 30.

In this fashion, it is to be understood that the embodiments illustrated and discussed herein should be taken as exemplary in nature only, and the scope of the present invention should be limited only by the claims that follow.

We claim:

1. An athletic shoe comprising:

an upper;

a resilient mid-sole attached to the upper;

an out-sole attached to the mid-sole;

absorbing means, disposed in the mid-sole, for absorbing shock energy and returning at least a portion of the absorbed shock energy to the foot of the wearer; and means, operatively connected with the absorbing means, for adjusting an amount of shock energy absorbed and returned by the absorbing means, wherein the absorbing means is disposed in the mid-sole below the wearer's heel and comprises a spring mechanism having a spring member connected in a cantilevered position relative to a lower plate.

2. An athletic shoe comprising:

an upper;

a resilient mid-sole attached to the upper;

an out-sole attached to the mid-sole;

absorbing means, disposed in the mid-sole, for absorbing shock energy and returning at least a portion of the absorbed shock energy to the foot of the wearer; and means, operatively connected with the absorbing means, for adjusting an amount of shock energy absorbed and returned by the absorbing means, wherein the absorbing means is disposed in the mid-sole below the wearer's heel and comprises a spring mechanism having a spring member and a lower plate, wherein the spring member is disposed in a cantilevered position above the lower plate, the absorbing means further including a fulcrum movably disposed between the spring member and lower plate, and wherein the adjusting means comprises positioning means for selectively positioning the fulcrum at one of a plurality of positions between the spring member and lower plate.

3. An athletic shoe according to claim 2, wherein the positioning means includes wearer control means, disposed on a surface of the athletic shoe, for enabling the wearer to selectively control the position of the fulcrum.

4. An athletic shoe according to claim 3, wherein the wearer control means comprises a knob connected to the positioning means, the knob being disposed in an exterior surface of the mid-sole.

5. An athletic shoe according to claim 3, further including indication means for providing the wearer with an indication of a position of the fulcrum relative to at least one of the spring member and the lower plate.

6. An athletic shoe according to claim 5, wherein the mid-sole includes a recess formed in an exterior surface thereof, the indication means including an indicator rod having a first end connected to the fulcrum and a second end disposed in the recess.

7. An athletic shoe according to claim 6, wherein the mid-sole includes a transparent plate disposed so as to cover the recess, the second end of the indicator rod being visible to the wearer through the transparent plate.

8. An athletic shoe comprising:

an upper;

a resilient mid-sole attached to the upper;

an out-sole attached to the mid-sole;

absorbing means, disposed in the mid-sole, for absorbing shock energy and returning at least a portion of the absorbed shock energy to the foot of the wearer; and means, operatively connected with the absorbing means, for adjusting an amount of shock energy absorbed and returned by the absorbing means, wherein the absorbing means is disposed in the mid-sole below the wearer's heel and comprises a spring mechanism having a spring member and a lower plate, wherein the lower plate includes a forward portion and a rear portion, the rear portion including means for stabilizing the wearer's foot, thereby preventing over-supination and over-pronation.

9. A shoe comprising:

an upper;

a resilient sole attached to the upper;

absorbing means, disposed in the sole, for absorbing a selectable amount of foot-strike shock energy and returning at least a portion of the absorbed shock energy to the foot of the wearer; and means, operable by the wearer and operatively connected with the absorbing means, for selecting the amount of foot-strike shock energy to be absorbed and returned by the absorbing means, wherein the absorbing means is disposed below the wearer's heel and comprises a spring mechanism having a spring member connected in a cantilevered position relative connected to a lower plate.

10. A shoe comprising:

an upper;

a resilient sole attached to the upper;

absorbing means, disposed in the sole, for absorbing a selectable amount of foot-strike shock energy and returning at least a portion of the absorbed shock energy to the foot of the wearer; and means, operable by the wearer and operatively connected with the absorbing means, for selecting the amount of foot-strike shock energy to be absorbed and returned by the absorbing means, wherein the absorbing means is disposed below the wearer's heel and comprises a spring mechanism having a spring member and a lower plate, wherein the spring member is disposed in a cantilevered position above the lower plate and is deflectable in a vertical direction, the means for selecting including a fulcrum movably disposed between the spring member and the lower plate, and means for moving the fulcrum to a selected position between the spring member and lower plate.

11. A shoe according to claim 10, wherein the means for moving includes selection means, disposed on a surface of the shoe, for enabling the wearer to selectively position the fulcrum.

12. A shoe according to claim 11, wherein the selection means comprises a knob connected to the means for moving, the knob being disposed in an exterior surface of the sole.

13. A shoe comprising:

an upper;

a resilient sole attached to the upper;

absorbing means, disposed in the sole, for absorbing a selectable amount of foot-strike shock energy and returning at least a portion of the absorbed shock energy to the foot of the wearer; and means, operable by the wearer and operatively connected with the absorbing means, for selecting the amount of foot-strike shock energy to be absorbed and returned by the absorbing means, wherein the absorbing means is disposed below the wearer's heel and comprises a spring mechanism having a spring member and a lower plate, wherein the lower plate includes a forward portion and a rear portion, the rear portion including means for stabilizing the wearer's foot, thereby preventing over-supination and over-pronation.

14. A shoe according to claim 13, wherein the rear portion of the lower plate has a predetermined size and includes an edge positioned so as to be disposed slightly outboard of the wearer's heel to provide lateral stability to the foot of the wearer.

15. A method for absorbing a selectable amount of foot-strike shock energy in an athletic shoe having an upper, a resilient mid-sole attached with the upper, and an outer sole attached to the mid-sole, the method comprising the steps of:

disposing absorbing means, comprising a spring mechanism having a spring member connected in cantilevered position relative connected to a lower plate for absorbing shock energy and returning at least a portion of the absorbed shock energy to the foot of the wearer, in the mid-sole of the athletic shoe; and providing selection means, for selecting the amount of shock energy to be absorbed and returned by the absorbing means and operatively connected with the absorbing means, on a surface of the athletic shoe.

* * * * *